US006320307B1

(12) United States Patent
Tanaka

(10) Patent No.: US 6,320,307 B1
(45) Date of Patent: Nov. 20, 2001

(54) COLOR CATHODE RAY TUBE HAVING IMPROVED ARRANGEMENT OF ELECTRON BEAMS

(75) Inventor: Toshiyuki Tanaka, Shiga (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/253,757

(22) Filed: Feb. 22, 1999

(30) Foreign Application Priority Data

Jun. 17, 1998 (JP) ..... 10-169525
Aug. 12, 1998 (JP) ..... 10-227470

(51) Int. Cl.[7] ..... H01J 29/50
(52) U.S. Cl. ..... 313/412; 313/414
(58) Field of Search ..... 313/412, 409, 313/413, 414, 441, 458, 461; 430/942

(56) References Cited

U.S. PATENT DOCUMENTS 5,013,963 * 5/1991 Ikegami et al. ..... 313/412
5,424,604 6/1995 Hyun ..... 313/414
5,682,079 * 10/1997 Kang ..... 313/461
5,898,260 * 4/1999 Misono ..... 313/412

FOREIGN PATENT DOCUMENTS 93-1483 1/1993 (KR) .
98-28111 7/1998 (KR) .

OTHER PUBLICATIONS

Korean Office Action, dated Dec. 13, 2000, with English language translation of Korean Examiner's comments.

* cited by examiner

*Primary Examiner*—Nimeshkumar D. Patel
*Assistant Examiner*—Todd Reed Hopper
(74) *Attorney, Agent, or Firm*—McGuireWoods, LLP

(57) ABSTRACT

The color cathode ray tube disclosed herein includes an in-line electron gun from which three electron beams are generated for displaying red, green and blue colors, respectively. The central electron beam (1B) is used to allow a blue fluorescent material to shine, whereas the electron beams (1R and 1G) or both sides are used to allow a red fluorescent material (3R) and a green fluorescent material (3G) to shine, respectively. The diameters of apertures (4R) and (4G) on both sides of an inner electrode (4) are preferably larger than that of the central aperture (4B).

5 Claims, 5 Drawing Sheets

COLOR CATHODE RAY TUBE HAVING IMPROVED ARRANGEMENT OF ELECTRON BEAMS

BACKGROUND OF THE INVENTION

1. Field of the Invention

The present invention relates to a color display tube for high resolution and, more particularly, to a color cathode ray tube with an in-line electron gun.

2. Description of the Related Art

The description will be made first on a conventional color cathode ray tube with reference to FIG. 4. In this drawing, three electron beams 11R, 11G, and 11B generated by an in-line electron gun 11 are used for red, green and blue fluorescent materials, respectively, and pass through a hole 12*a* of a shadow mask 12. On the other hand, there are provided stripe-shaped fluorescent materials 13R, 13G, and 13B of red, green and blue on a display screen 13 of a glass bulb or tube (not shown). Accordingly, the central electron beam 11G allows the green fluorescent material 13G to shine, whereas outer electron beams 11R and 11B allow the red and blue fluorescent materials 13R and 13B to shine, respectively.

Referring to FIG. 5 the electron gun 11 (FIG. 4) includes an electrode 14 in the main lens thereof. There are provided three apertures 14R, 14G, and 14B in the main lens of the gun 11. These apertures 14R, 14G and 14B are designed to be the same in diameter as one another for such reasons as to prevent imbalance of the strengths of electrostatic lenses produced at each electrode and to hold the strength of the inner electrode 14.

In order to enhance the focus property of the color cathode ray tube, it is required to improve the spherical aberration of the electrostatic lens formed among the electrodes. In general, in order to provide an electrostatic lens small in the spherical aberration, it is effective to enlarge the aperture diameter of the main lens unit.

However, it is impossible for the circular aperture-type electron gun 11 shown in FIG. 5 to enlarge the diameter of each aperture 14 due to the strength of the inner electrode 14.

Moreover, although it is required to correct the convergence for focus the three electron beams 11R, 11G and 11B on the screen surface, such correction can be done with the help of the ferrite and/or the magnet or other related materials with respect to the red electron beam 11R and the blue electron beam 11B. However, it is impossible to correct the green electron beam 11G with such means.

Furthermore, in the circular aperture-type electron gun 11, the central electron gun is inferior, in the electron gun's characteristics, to the outer electron guns. This emanates from the experimental comparison, made at the center of the screen, in terms of their focus property.

In addition to that, the central electron beam corresponds to green, and its electric current is more than those of the outer electron guns, in operation. This leads to further degradation of the focus property.

Furthermore, the brightness characteristic is the one to influence the outward appearance on the screen of the cathode ray tube.

The easiest method to enhance the brightness is to enlarge the areas of the fluorescent materials. However, simply enlarging the areas easily causes occurrence of problems such as a mixture with the color of the adjacent fluorescent material.

Alternatively, enlarging the area of the fluorescent material corresponding to green, which greatly contributes to the brightness, causes an increase of the electric current for red, which violently changes more than usual, based upon the color temperature. In addition, the focus property may degrade in a low color temperature.

SUMMARY OF THE INVENTION

Accordingly, an object of the present invention is to provide an improved color display tube.

It is another object of the present invention to provide a color cathode ray tube with solving the above problems to present a visually attractive-looking screen.

According to an aspect of the present invention, such a color cathode ray tube is provided that among three electron beams generated from an in-line electron gun, a center one is used for a blue color. That is, the center beam is used to irradiate a blue fluorescent material. The both ends of the three beams are used to irradiate respectively red and green fluorescent materials, accordingly.

It is convenient to make the area of the blue fluorescent material smaller than the red and green fluorescent materials.

In the preferred embodiment, the in-line gun has an electrode into which three apertures are provide for the three electron beams, and the center aperture is made smaller in diameter than the remaining apertures.

With the above construction in which a central electron beam tends to degrade in its focus property more than those of the electron beams on both sides, the blue fluorescent material which is lower in sensibility from the view point of the human engineering than a red and a green fluorescent material, corresponds to the central electron beam. Therefore, even though the focus properties of the fluorescent materials on both sides are inferior, this fact does not influence the display on the screen of the color cathode ray tube very much.

Moreover, for the blue fluorescent material, the electric current is lower than those of other color fluorescent materials. Even though the blue fluorescent material corresponds to the central electron beam, the focus property does not degrade very much.

In addition to the aforementioned configuration, the main lens unit aperture hole of the electron beam side gun is larger in diameter than the central gun. Thereby, the spherical aberration is improved, and the focus property is improved accordingly.

Wherein, from the necessity for maintaining the strength of the inner electrode, the diameter of the aperture of the central gun becomes small, conversely. Accordingly, the spherical aberration of the electrostatic lens degrades more than that of the side gun. However, as described above, since the blue is low in sensibility and the electric current ratio is low, the display on the screen of the color cathode ray tube can be maintained against something such as a blur.

Moreover, in addition to the configuration where the arrangement of the array of fluorescent materials are changed in such a manner that the fluorescent material corresponding to the central electron beam is blue, whereas the other fluorescent materials corresponding to the electron beams on both sides are red and green, the areas of fluorescent materials corresponding to the electron beams on both sides are enlarged. Therefore, lower electric current than ever is necessary, and the focus property on both sides is improved.

Furthermore, the green corresponding to the electron beams on both sides influences the intensity. This leads to an improvement of the intensity.

BRIEF DESCRIPTION OF DRAWINGS

The above and other objects, features and advantages of the present invention will be made more apparent through the detailed description hereafter, especially when taken in conjunction with the accompanying drawings, wherein.

DETAILED DESCRIPTION OF THE PREFERRED EMBODIMENTS

Figure 1:
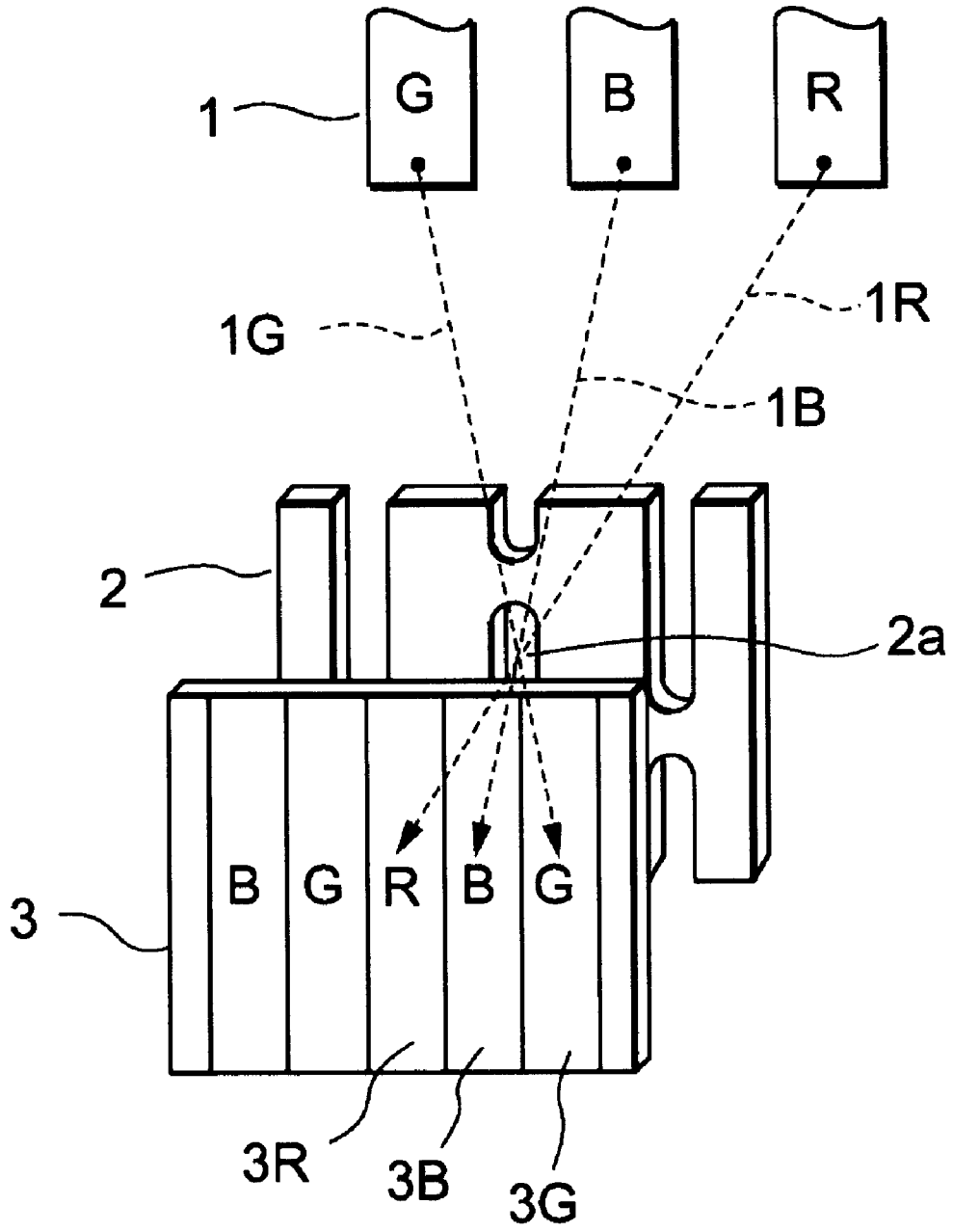
FIG. 1 is a schematic view illustrative of three electron beams and an array of fluorescent materials of a color cathode ray tube according to an embodiment of the present invention.

Referring now to FIG. 1, a cathode ray tube according to an embodiment of the present invention includes an in-line electron gun 1 generating three electron beams 1G, 1B, and 1R. The center beam 1B is provided for a blue color. The left-hand and right-hand electron beams 1G and 1R are allotted for green and red colors, respectively, in this embodiment. If desired, the left-hand and right-hand beams can be used for red and green colors, respectively. These three beams 1G, 1B and 1R pass through a single hole 2*a* of a shadow mask 2. Of the stripes of fluorescent materials 3R, 3G, and 3B formed on the inner wall of a glass bulb or tube, i.e., a screen surface, the blue fluorescent material 3B is inserted between the red and green ones and shines on reception of the central electron beam 1B. On the other hand, the red fluorescent material 3R and the green fluorescent material 3G shine on reception of the outer electron beams 1R and 1G, respectively.

As a result, for the circular aperture-type electron gun having the characteristic in which the central electron beam tends to degrade in its focus property more than those of the electron beams 1R and 1G on both sides, the blue fluorescent material 3B which is lower in sensibility from the view point of human engineering than the red and the green fluorescent material, corresponds to the central electron beam 1B. Therefore, even though the focus property of the central fluorescent material is inferior than those on both sides, this fact does not influence the display on the screen of the color cathode ray tube very much.

Figure 2:
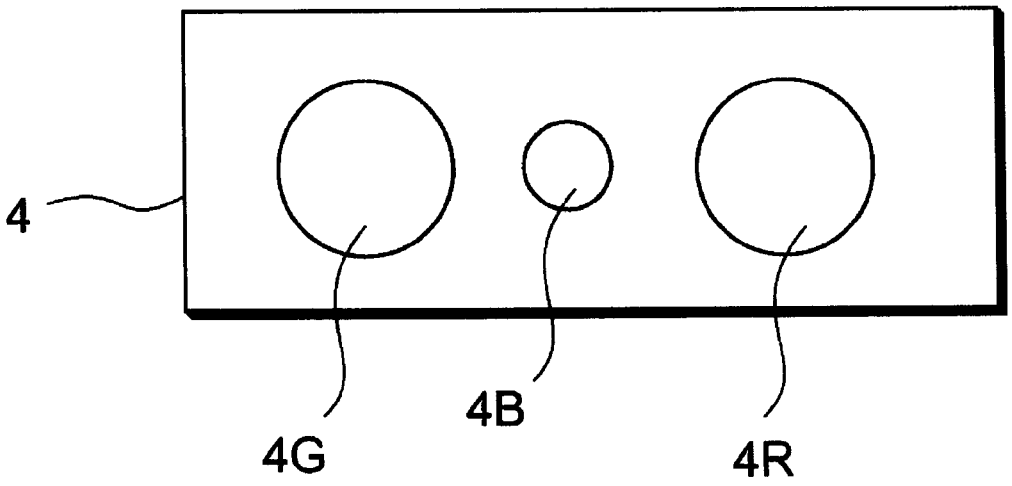
FIG. 2 is a schematic view illustrative of the shape of the holes of an inner electrode in the electron gun main lens unit of the color cathode ray tube according to the embodiment of the present invention.

Turning to FIG. 2 representing the shape of the inner electrode's holes of a main lens unit of the in-line electron gun 1, the diameters of the green and red apertures 4G and 4R of the inner electrodes are made substantially equal to each other and are made larger than the diameter of the central aperture 4B for a blue color. With this configuration, although the spherical aberration of electrostatic lenses formed in the central gun is rather inferior as described above, those formed on the side guns have been improved and the aforementioned array of fluorescent materials gives good results, so that the possible blurs displayed on the screen of the color cathode ray tube can be totally improved.

In addition, since the aperture diameter of the aperture 4R around the center of the inner electrode 4 is small, the area of the board left is large. This causes much improvement of the inner electrode 4 in physical strength.

Figure 3:
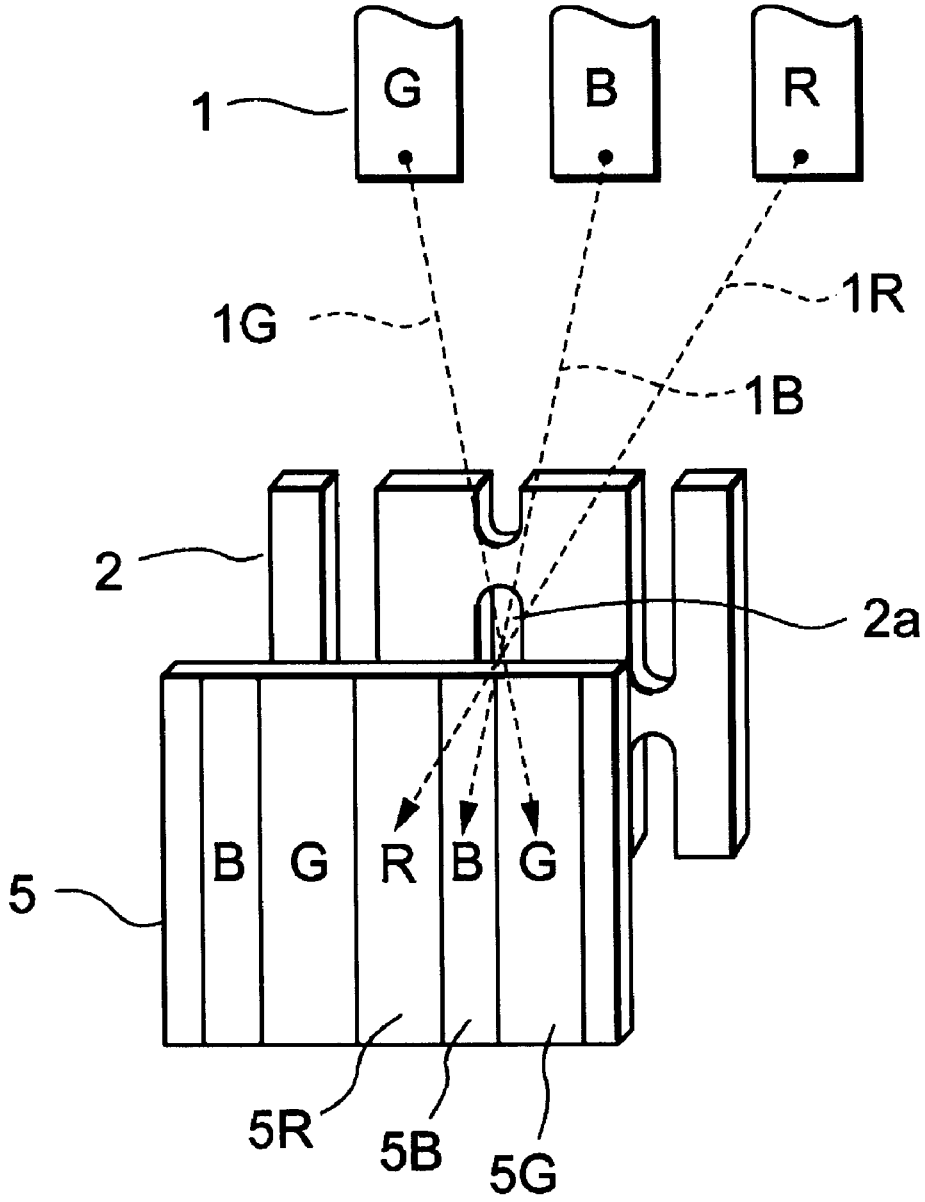
FIG. 3 is a schematic view illustrative of three electron beams and an array of fluorescent materials of a color cathode ray tube according to another embodiment of the present invention.
Figure 4:
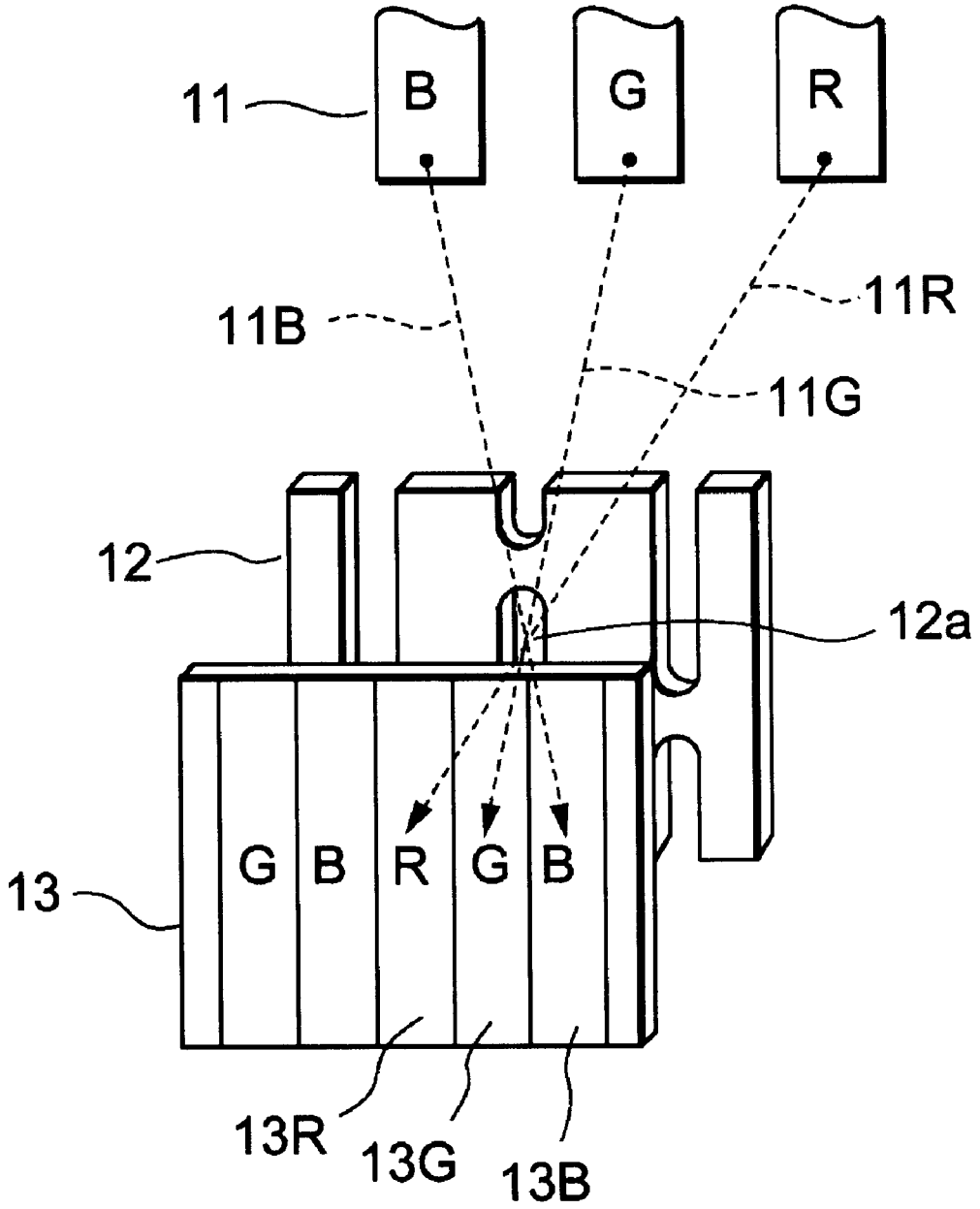
Fig.4 PRIOR ART
FIG. 4 is a view indicative of electron beams and an array of fluorescent materials of the conventional color cathode ray tube.
Figure 5:
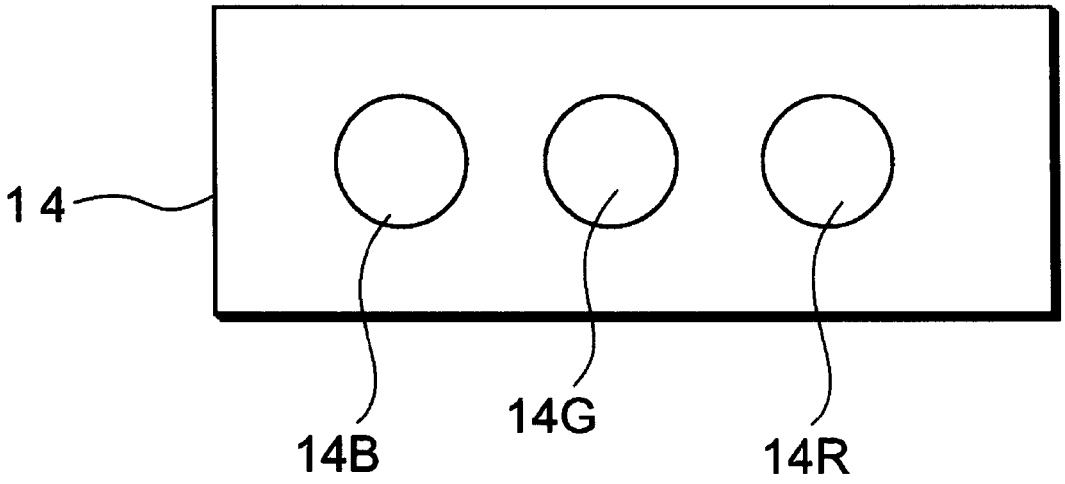
FIG. 5 is a view of the shape of the holes of an inner electrode in the electron gun main lens unit of the conventional color cathode ray tube.

Referring to FIG. 3, there is shown another embodiment of the present invention in which the same constituents as those shown in FIG. 1 are denoted by the same reference numerals to omit the further description thereof.

In this figure, the areas of the stripes of red, blue and green fluorescent materials 5R, 5B, and 5G are further improved, wherein the area of the blue fluorescent material 5B is smaller than those of the red fluorescent material 5R and the green fluorescent material 5G.

According to this embodiment, without any change in the shape of the hole of the inner electrode of the main lens unit of the electron gun, the blue fluorescent material, which is lower in sensibility from the view point of human engineering than a red and a green fluorescent material, corresponds to the central electron beam. Therefore, even though the focus properties of the fluorescent materials of both sides are rather inferior, this fact does not influence the display on the screen of the color cathode ray tube very much. In addition, since the electric current for the blue fluorescent material is smaller than those of other color fluorescent materials, even though it corresponds to the central electron beam, possible degradation of the focus is not large.

Moreover, since a lower electric current than ever is necessary, the focus characteristics on both sides are enhanced. In addition, since the greens corresponding to the electron beams on both sides greatly influence the intensity, the intensity is improved.

As described above, according to the present invention, a central electron beam shot from a color cathode ray tube electron gun allows a blue fluorescent material to shine, whereas the outer electron beams allow a red fluorescent material and a green fluorescent material to shine. In addition, the diameters of the apertures on both sides of the inner electrode are larger than that of the central aperture, and the blue is low in sensibility and low in its electric current ratio. Therefore, the display on the screen of the color cathode ray tube can be totally improved. Furthermore, since the diameter of the aperture around the center of the inner electrode is small, the physical strength of the inner electrode can be enhanced.

Furthermore, in addition to the configuration where the arrangement of the fluorescent materials has been modified in such a manner that the fluorescent material corresponding to the central electron beam is blue, whereas the fluorescent materials corresponding to the electron beams on both sides are red and green, respectively, the areas of the fluorescent materials corresponding to the electron beams of both sides are enlarged. Thereby, lower electric currents than ever are necessary, and the focus characteristics on both sides are improved.

Moreover, the green corresponding to the electron beams on both sides greatly influences the intensity so that the intensity will be improved.

While the present invention has been described in connection with certain preferred embodiments, it is understood that the subject matter encompassed by the present invention is not limited to those specific embodiments. On the contrary, it is intended to include all alternatives, modifications, and equivalents as can be included within the spirit and scope of the following claims.

What is claimed is:

1. A color cathode ray tube comprising an in-line electron gun generating three electron beams, a central one of said three electron beams being used for displaying a blue color, and remaining ones of said three electron beams being used for displaying red and green colors, respectively.

2. The color cathode ray tube as claimed in claim 1, further comprising red, green and blue fluorescent materials at a display surface, said blue fluorescent material being smaller in area than said red and green fluorescent materials.

3. The color cathode ray tube as claimed in claim 1, wherein said in-line electron gun includes an inner electrode in which three apertures are provided for said three electron beams, a central one of said three apertures being smaller in diameter than remaining apertures.

4. The color cathode ray tube as claimed in claim 2, said red, green and blue fluorescent materials are formed as a stripe.

5. The color cathode ray tube as claimed in claim 2, wherein said in-line electron gun includes an inner electrode in which three apertures are provided for said three electron beams, a central one of said three apertures being smaller in diameter than remaining apertures.

* * * * *